US008439542B2

(12) United States Patent
Sekiguchi

(10) Patent No.: US 8,439,542 B2
(45) Date of Patent: May 14, 2013

(54) VEHICLE LIGHT

(75) Inventor: Tatsuya Sekiguchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 236 days.

(21) Appl. No.: 13/097,044

(22) Filed: Apr. 28, 2011

(65) Prior Publication Data

US 2011/0267832 A1 Nov. 3, 2011

(30) Foreign Application Priority Data

Apr. 28, 2010 (JP) ..... 2010-104161
Apr. 28, 2010 (JP) ..... 2010-104162

(51) Int. Cl.
*F21S 8/10* (2006.01)
*F21V 21/00* (2006.01)

(52) U.S. Cl.
USPC ..... 362/545; 362/507; 362/539

(58) Field of Classification Search ..... 362/227–248, 362/249.02, 311.02, 459–468, 507–522, 362/538–539, 543–545, 800
See application file for complete search history.

(56) References Cited

FOREIGN PATENT DOCUMENTS

JP 2009-245637 A 10/2009

*Primary Examiner* — Jason Moon Han
(74) *Attorney, Agent, or Firm* — Kenealy Vaidya LLP

(57) ABSTRACT

A vehicle light can maintain its maximum light intensity in its light distribution pattern while improving the brightness sense at a farther area. The vehicle light can be provided in a front portion of a vehicle body, for forming a road surface light distribution pattern on a road surface in front of the vehicle body. The road surface can include at least a farther area, an intermediate area, and a nearby area. The road surface light distribution pattern can include a plurality of light source images each extending in a horizontal direction, the respective light source images being projected to the corresponding farther area, intermediate area and nearby area, respectively, without striding across the adjacent areas. The vehicle light can include an LED light source having a rectangular light emission surface with a short side of 0.6 to 0.8 mm, and an optical system configured to project the plurality of light source images each extending in the horizontal direction to the corresponding farther area, intermediate area and nearby area, respectively, without striding across the adjacent areas, thereby optimizing the road surface illuminance in each of the farther area, intermediate area and nearby area.

22 Claims, 14 Drawing Sheets

VEHICLE LIGHT

This application claims the priority benefit under 35 U.S.C. §119 of Japanese Patent Applications No. 2010-104161 filed on Apr. 28, 2010 and No. 2010-104162 filed on Apr. 28, 2010, which are hereby incorporated in their entirety by reference.

TECHNICAL FIELD

The presently disclosed subject matter relates to a vehicle light, and in particular, to a vehicle light that can maintain its maximum light intensity in its light distribution pattern while improving the brightness sense at a farther area.

BACKGROUND ART

In the conventional vehicle headlamp utilizing an LED light source, the distant visibility is often desired to be improved. In order to cope with this demand, vehicle lights utilizing a plurality of LED light sources have been proposed (for example, Japanese Patent Application Laid-Open No. 2009-245637). The vehicle light can include LED light sources and project the images of the LED light sources to form a low beam light distribution pattern on a virtual vertical screen, for example, as shown in FIG. 1. Here, the low beam light distribution pattern can include a maximum light intensity area known as a hot zone (high light intensity area).

The vehicle light disclosed in Japanese Patent Application Laid-Open No. 2009-245637, however, is configured without paying attention to the road surface illuminance in the area nearer than a farther area (for example, the area in front of a vehicle, approximately 100 m away from the vehicle) even when it can provide the desired maximum light intensity. This means that the vehicle light of the conventional type can control the light emission to obtain the maximum light intensity while it may have a great impact on the road surface illuminance in the nearer area. Accordingly, the conventional vehicle light may have the problem in which the sense of brightness in the farther area may deteriorate.

SUMMARY

The presently disclosed subject matter was devised in view of these and other problems and features and in association with the conventional art. According to an aspect of the presently disclosed subject matter, a vehicle light can maintain its maximum light intensity in its light distribution pattern while improving the brightness sense at a farther area.

According to another aspect of the presently disclosed subject matter, a vehicle light can be provided in a front portion of a vehicle body, for forming a road surface light distribution pattern on a road surface in front of the vehicle body, the road surface including at least a farther area, an intermediate area, and a nearby area. The road surface light distribution pattern can include a plurality of light source images each extending in a horizontal direction, the respective light source images being caused to be projected to the corresponding farther area, intermediate area and nearby area, respectively, without striding across adjacent areas.

In the above described vehicle light, the plurality of light source images can be configured to extend in the horizontal direction and can be projected onto the farther area, intermediate area and nearby area, respectively. These light source images can be adjusted in terms of the number, size, and the like, so that the road surface illumination in the respective areas can be separately adjusted. For example, the light source images can be adjusted so that the brightness in the farther area can be increased while the brightness in the intermediate area that is adjacent to the farther area can be decreased. In this manner, the sense of brightness in the farther area can be improved while the maximum light intensity can be maintained. Specifically, in the above configuration, the road surface illuminance can be controlled separately in each of the areas, so that the road surface illuminance in each of the areas can be optimized.

In the vehicle light configured as described above, the farther area can be an area in front of the vehicle body 100 m or more away from the vehicle body, the nearby area can be an area in front of the vehicle body 10 m or less away from the vehicle body, and the intermediate area can be an area interposed between the farther area and the nearby area.

In the vehicle light configured as described above, the road surface illuminance in the farther area can be 5 lux or more, the road surface illuminance in the nearby area can be 180 lux or less, and the road surface illuminance in the intermediate area can be an illuminance being a value positioned below a straight line in a coordinate system with the road surface illuminance being a vertical axis and the distance from the vehicle body being a horizontal axis, the line connecting the road surface illuminance in the farther area at a distance around 100 m away from the vehicle body in front of the vehicle body and the road surface illuminance in the nearby area at a distance around 10 m away from the vehicle body in front of the vehicle body in the coordinate system.

In the vehicle light configured as described above, an illuminance peak in the light distribution pattern formed on a virtual vertical screen positioned a predetermined distance away from the vehicle body in front of the vehicle body can be disposed below a horizontal line in the light distribution pattern by about 0.5° (or substantially 0.5°).

The vehicle light configured as described above can include an LED light source having a rectangular light emission surface with a short side of 0.6 to 0.8 mm, and an optical system configured to project the plurality of light source images each extending in the horizontal direction to the corresponding farther area, intermediate area and nearby area, respectively, without striding across the adjacent areas, thereby optimizing the road surface illuminance in each of the farther area, intermediate area and nearby area.

In a vehicle light configured as described above, the optical system can adjust the plurality of light source images to be horizontally elongated in terms of the number, size, and the like, so that the light source images can be projected to the respective farther area, intermediate area and nearby area. Accordingly, the road surface illumination in the respective areas can be separately adjusted. For example, the light source images can be adjusted so that the brightness in the farther area can be increased while the brightness in the intermediate area that is adjacent to the farther area can be decreased. In this manner, the sense of brightness in the farther area can be improved while the maximum light intensity can be maintained. By the action of the optical system, the road surface illuminance is controlled separately in each of the areas, so that the road surface illuminance in each of the areas can be optimized.

In a vehicle light configured as described above, the illuminance peak in the light distribution pattern formed on the virtual vertical screen can be disposed near the horizontal cut-off line (below the horizontal line by about 0.5°). This configuration can increase the light intensity near the cut-off line, thereby improving distance visibility.

In a vehicle light configured as described above, the optical system can be a projector type optical system including a projection lens, a reflecting surface, and a light shielding member having an upper edge and disposed between the projection lens and the reflecting surface. The reflecting surface can be a revolved elliptical reflecting surface having a first focal point at or near the light emission surface of the LED light source and a second focal point disposed at or near the upper edge of the light shielding member. The projection lens can have a focal point at or near the upper edge of the light shielding member.

In this way, a vehicle light configured as described above can be configured as a projector type vehicle light in which the sense of brightness in the farther area can be improved while the maximum light intensity can be maintained.

In a vehicle light configured as described above, the projection lens can have a focal distance of 20 to 45 mm, the reflecting surface can have a focal distance of 7 to 15 mm, and a distance between the focal point of the projection lens and the first focal point of the reflecting surface can be set to a range of 30 to 45 mm. The reflecting surface can be configured to project the plurality of light source images each extending in the horizontal direction to the corresponding farther area, intermediate area and nearby area, respectively, without striding across the adjacent areas.

A vehicle light configured as described above can be a projector type vehicle light with specified sizes, so that the sense of brightness in the farther area can be improved while the maximum light intensity can be maintained.

In an alternative mode of the vehicle light configured as described above, the optical system can be a reflector type optical system including a revolved parabolic reflecting surface having a focal point disposed at or near the light emission surface of the LED light source.

In this way, a vehicle light configured as described above can be configured as a reflector type vehicle light in which the sense of brightness in the farther area can be improved while the maximum light intensity can be maintained.

In a vehicle light configured as described above, the reflecting surface can have a focal distance of 16 to 24 mm. The reflecting surface can be configured to project the plurality of light source images each extending in the horizontal direction to the corresponding farther area, intermediate area and nearby area, respectively, without striding across the adjacent areas.

The vehicle light configured as described above can be a reflector type vehicle light with specified sizes, so that the sense of brightness in the farther area can be improved while the maximum light intensity can be maintained.

In an alternative mode of the vehicle light configured as described above, the optical system can be a direct type optical system including a projection lens having a focal point disposed at or near the light emission surface of the LED light source.

In this way, a vehicle light configured as described above can be configured as a direct-projection type vehicle light in which the sense of brightness in the farther area can be improved while the maximum light intensity can be maintained.

In a vehicle light configured as described above, the projection lens can have a rear-side focal distance of 20 to 45 mm. The projection lens can be configured to project the plurality of light source images each extending in the horizontal direction to the corresponding farther area, intermediate area and nearby area, respectively, without striding across the adjacent areas.

A vehicle light configured as described above can be a direct-projection type vehicle light with specified sizes, so that the sense of brightness in the farther area can be improved while the maximum light intensity can be maintained.

A vehicle light as described above can maintain its maximum light intensity in its light distribution pattern while improving the brightness sense at a farther area.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to exemplary embodiments of vehicle lights made in accordance with principles of the presently disclosed subject matter with reference to the accompanying drawings.

Herein, the directions including a vertical direction (up and down directions), front-to-rear direction, horizontal direction (right and left directions, width direction), and the like may be described on the basis of the state where the vehicle light is mounted on a vehicle body unless otherwise specified.

Figure 1:
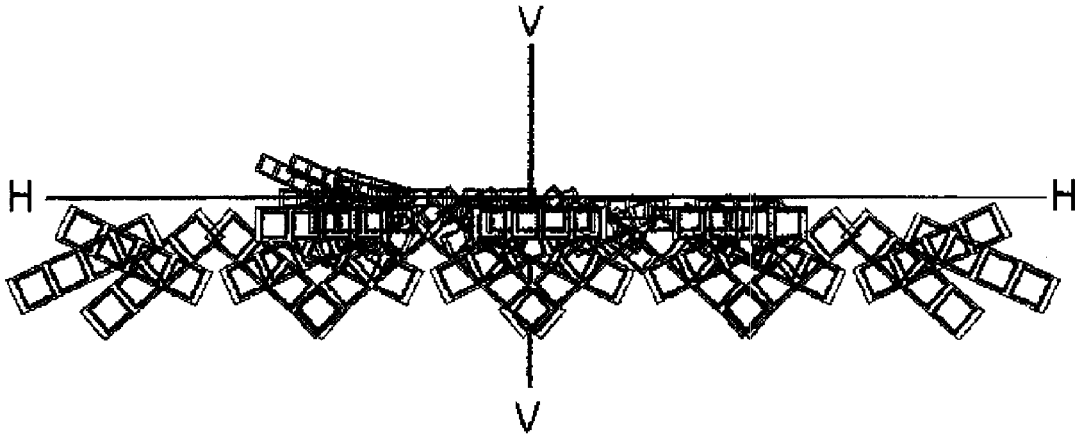
Fig. 1 Conventional Art
FIG. 1 is a diagram illustrating a conventional low beam light distribution pattern formed by a vehicle headlamp utilizing an LED light source on a virtual vertical screen.
Figure 2:
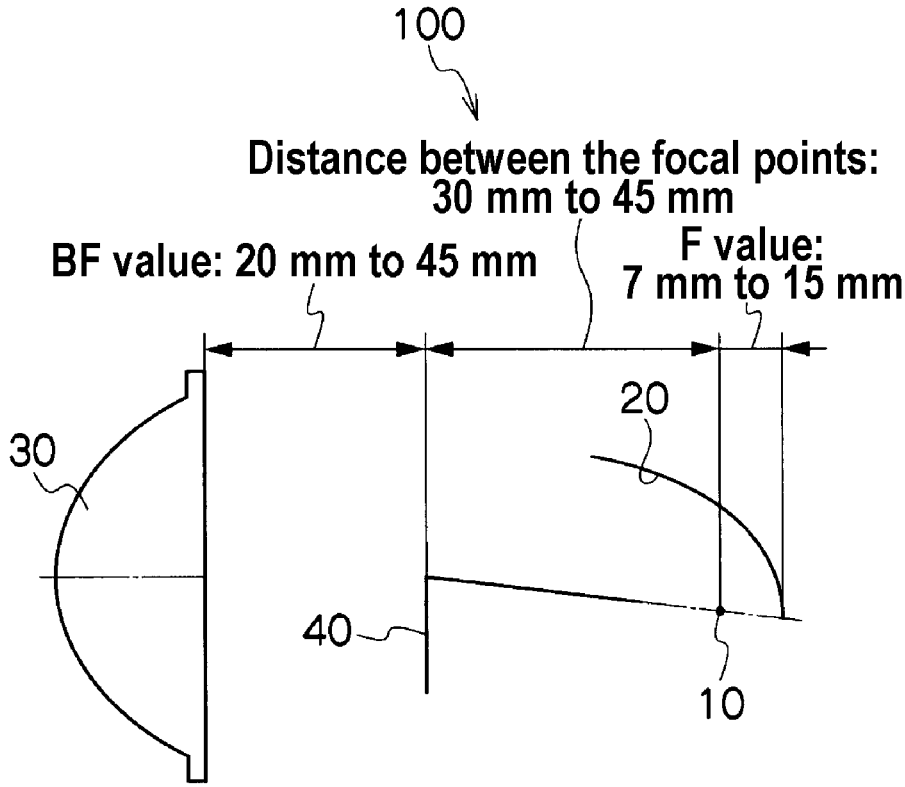
FIG. 2 is a schematic vertical cross sectional view of a vehicle light made in accordance with principles of the presently disclosed subject matter.

FIG. 2 is a schematic vertical cross sectional view of a vehicle light 100 of an exemplary embodiment. The vehicle light 100 of the exemplary embodiment can be applied to a vehicle headlamp such as an automobile headlamp. The vehicle light 100 can be mounted on a front part of a vehicle body and on both widthwise ends of the vehicle body, for example.

As shown in FIG. 2, the vehicle light 100 can include an LED light source 10, a reflecting surface 20, a projection lens 30, a light shielding member or a shade 40, and the like. Note that the components in FIG. 2 and the like are schematically illustrated only with points and lines.

Figure 3A:
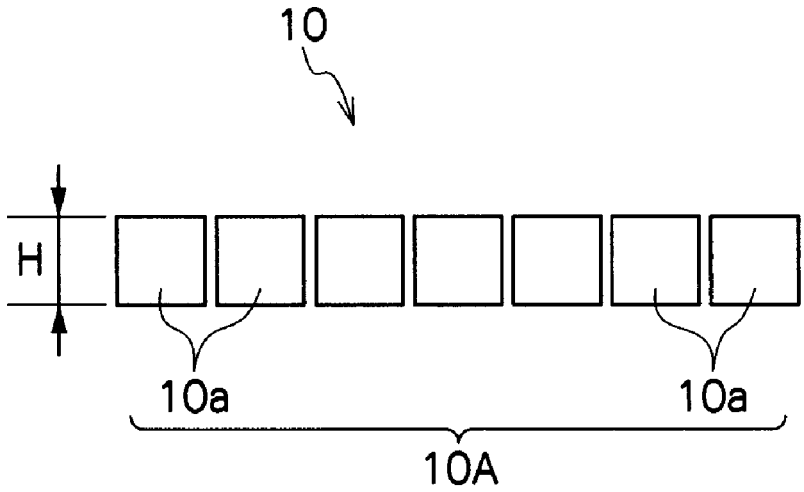
FIG. 3A is a front view schematically illustrating one example of an LED light source (including a light emission surface)
Figure 3B:
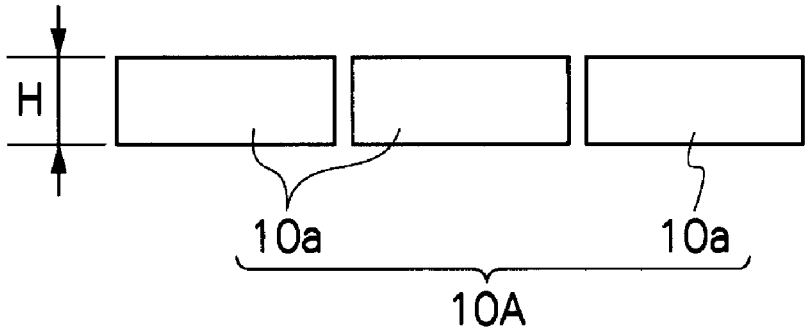
FIG. 3B is a front view schematically illustrating a modified example of an LED light source (including a light emission surface)

A description will now be given of the LED light source 10. FIG. 3A is a front view schematically illustrating one example of the LED light source 10, and FIG. 3B is a front view schematically illustrating a modified example of the LED light source 10. Specifically, the drawings illustrate a light emission surface 10A of the LED light source 10.

As shown in FIG. 3A, the LED light source 10 in the present exemplary embodiment can include a quadrangular (i.e., rectangular, square, etc.) light emission surface 10A with a shorter or shortest side H in the range of 0.6 mm to 0.8 mm when viewed from the front side. For example, the light emission surface 10A with a shorter/shortest side of 0.7 mm can be configured by arranging seven square LED chips 10*a* with a side H of 0.7 mm in line (see FIG. 3A).

It should be appreciated that the number of LED chips arranged can take 6 or less or 8 or more as long as the required luminous flux and brightness can be ensured. The shape of the LED chip 10*a* is not limited to a square shape, but can be any generally rectangular or quadrangular shape other than a square. In this case, the number of the LED chips to be installed can be determined in accordance with the single chip size (or its light emission surface size or light emission intensity). For example, as shown in FIG. 3B, three oblong LED chips 10*a* can be arranged in the lengthwise direction so that the total area of the light emission surfaces of the LED chips 10*a* is equal to the area of the shown light emission surface 10A in FIG. 3A.

The LED light source 10 with the above configuration can be disposed at a position denoted by the reference numeral 10 in the schematic diagram of FIG. 2 so that the light emission surface 10A faces upward (toward the reflecting surface 20) and the longer side of the rectangle is aligned in the horizontal direction (perpendicular to the sheet surface of the drawing).

The reflecting surface 20 can be disposed above the LED light source 10 (the light emission surface 10A) so that light beams emitted from the LED light source 10 (the light emission surface 10A) can impinge on the reflecting surface 20 as shown in FIG. 2. Further, the reflecting surface 20 can be a revolved elliptic reflecting surface that has a first focal point set at or near (substantially at) the light emission surface 10A and a second focal point at or near the upper edge of the shade 40. The F value thereof can be set to a range of 7 mm to 15 mm.

The projection lens 30 can be disposed to have its rear-side focal point at or near the upper edge of the shade 40. The BF value thereof (rear-side F value) can be set to a range of 20 mm to 45 mm.

The shade 40 can be disposed between the LED light source 10 (and the reflecting surface 20) and the projection lens 30. The distance between the first focal point of the reflecting surface 20 and the focal point of the projection lens 30 can be set to a value in the range of from 30 to 45 mm (see FIG. 2).

Figure 5:
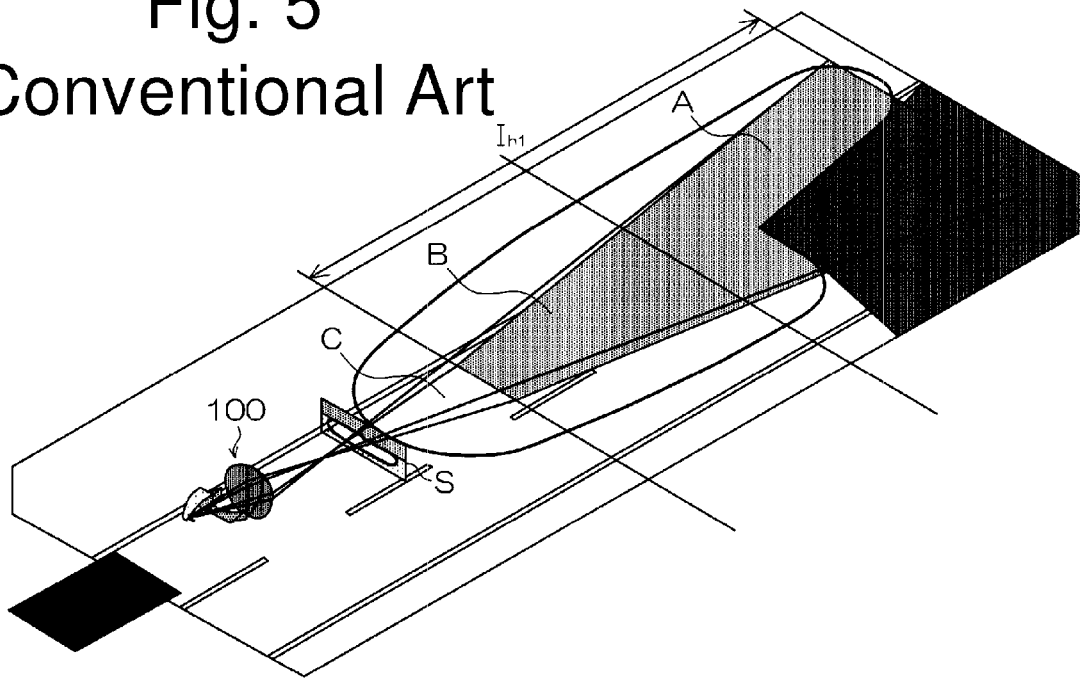
Fig. 5 Conventional Art
FIG. 5 is a schematic perspective view illustrating a problem in a conventional vehicle light utilizing a rectangular light emission surface having a short side larger than 0.8 mm (for example, H=1 mm)
Figures 8A, 8B:
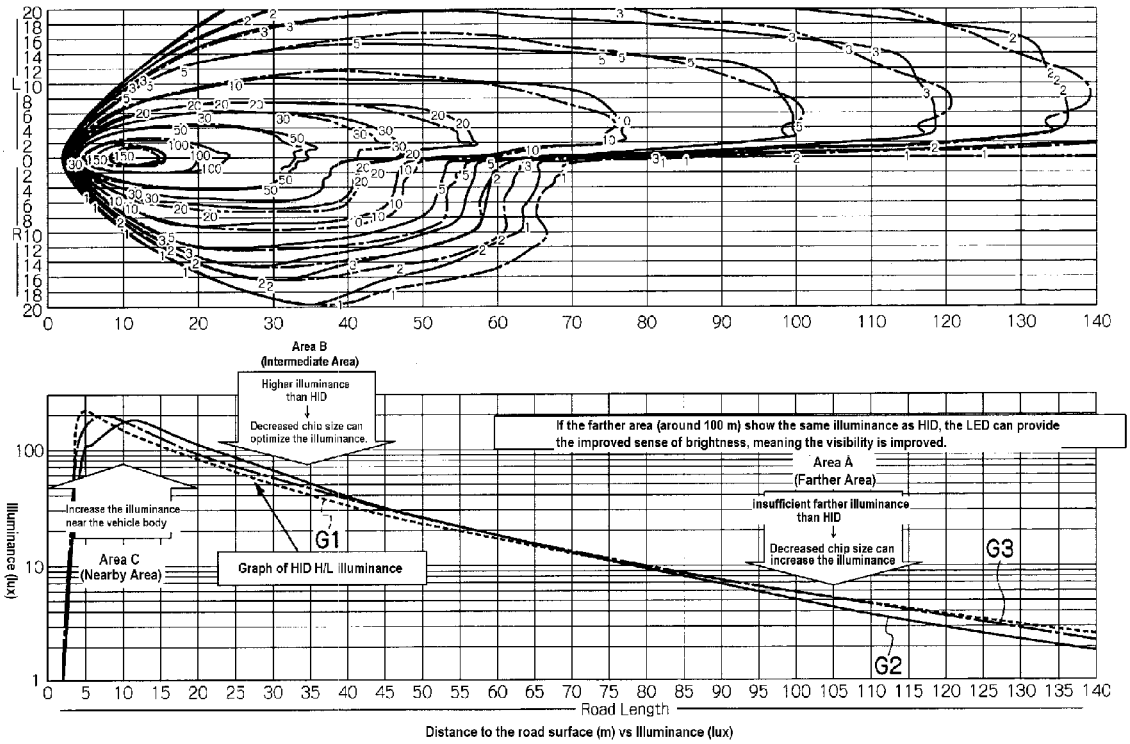
Fig. 8A Conventional Art
Fig. 8B Conventional Art
FIG. 8A is a diagram showing an equi-luminance curve on a road surface when a conventional vehicle light utilizes a rectangular light emission surface with a shorter side of 1.0 mm and an exemplary equi-luminance curve on a road surface when an embodiment of a vehicle light made in accordance with principles of the presently disclosed subject matter utilizes a rectangular light emission surface with a shorter side of 0.7 mm.
FIG. 8B is an illuminance distribution curve with the luminance curve of FIG. 8A as a cross section.

A description will now be given of the road surface projection area to be illuminated with the vehicle light and its associated problem with reference to FIG. 5. FIG. 5 illustrates the positional relationship between the virtual vertical screen S and the actual road surface projection area including the areas A to C (the area where the light source images are projected). The virtual vertical screen S is assumed to be disposed at a position a predetermined distance away from the vehicle light. FIG. 5 also illustrates the light source image $I_{h1}$ from the conventional vehicle light. Here, the road surface projection area can include a farther area A (an area approx. 100 m away from the vehicle body in front thereof), an intermediate area B (an area connecting the areas A and C and approx. 10 to 100 m away from the vehicle body in front thereof), and a nearby area C (an area approx. 10 m or less away from the vehicle body in front thereof). The area sections will be described with reference to FIG. 8B. If the light source of the conventional vehicle light is controlled to provide a desired high light intensity at the farther area A, the conventional light source image $I_{h1}$ may be projected so as to stride across the farther area A and the intermediate area B. Namely, in this conventional case, the road surface illuminance cannot be controlled separately at the respective areas A to C. In this case, the increasing of the brightness at the farther area A may increase the brightness at the intermediate area B. When a driver observes this illuminated road surface, the increased brightness at the intermediate area B may decrease the sense of brightness at the farther area A, whereby visibility may deteriorate. The presently disclosed subject matter aims to address this and other problems and issues.

In the exemplary vehicle light 100, the reflecting surface 20 can be configured to include reflecting areas each for reflecting and projecting the light source image $I_H$ of the LED light source 10 (light emission surface 10A) extending in the horizontal direction onto the corresponding one of the areas A to C without striding across adjacent areas. It should be noted that the reflecting surface 20 may include a reflecting area for reflecting and projecting the light source image $I_H$ of the LED light source 10 (light emission surface 10A) onto the areas A to C with striding across the adjacent areas while the effects on the adjacent area is minimized (overlapped images are minimized), a reflecting area for reflecting and projecting a light source image $I_O$ of the LED light source 10 extending in an oblique direction, and the like.

Figure 4:
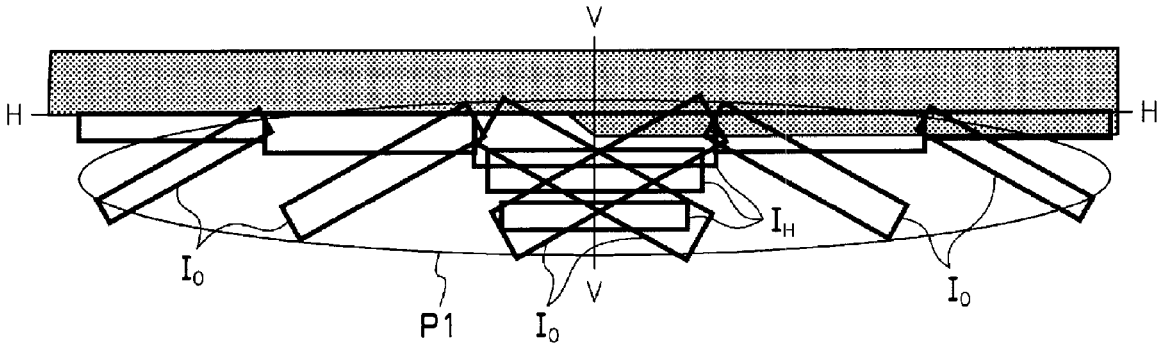
FIG. 4 is a diagram illustrating a light distribution pattern including light source images projected on a virtual vertical screen S by the vehicle light shown in FIG. 2.

In the vehicle light 100 with the above configuration, as shown in FIG. 4, the LED light source 10 (light emission surface 10A) can be reflected by the reflecting surface 20 and reflected by the same to be projected as the light source image $I_O$ extending in the oblique direction or as the light source image $I_H$ extending in the horizontal direction via the projection lens 30. These light source images can be overlaid with each other and form a desired light distribution pattern P1 assumed to be formed on a virtual vertical screen S disposed a predetermined distance away from a front of the vehicle light.

Figure 12:
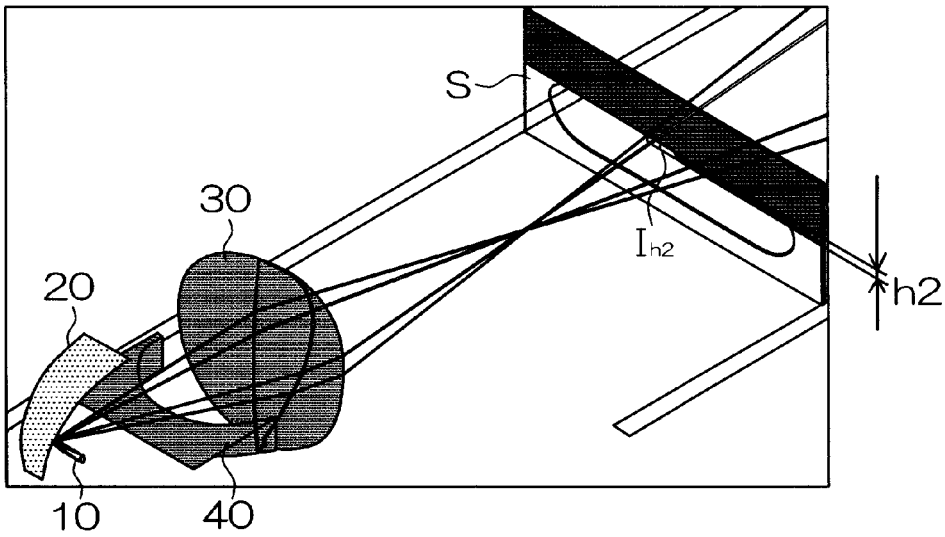
FIG. 12 is a schematic perspective view illustrating the height h2 of the light source image $I_{h2}$ projected on the virtual vertical screen S in the case wherein an embodiment of a vehicle light made in accordance with principles of the presently disclosed subject matter utilizes a rectangular light emission surface has a short side H=0.7 mm.

With reference to FIG. 12, a description will be given of a light source image projected onto an actual road surface. The light source image $I_H$ of the LED light source 10 (light emission surface 10A) extending in the horizontal direction can be projected onto the road surface projection area including the farther area A, the intermediate area B, and the nearby area C. It should be noted that the light source image $I_H$ may be projected onto the areas A to C with striding across the adjacent areas while the effect on the adjacent area is minimized. In this manner, the vehicle light 100 can form the road surface light distribution pattern P2.

Figure 6:
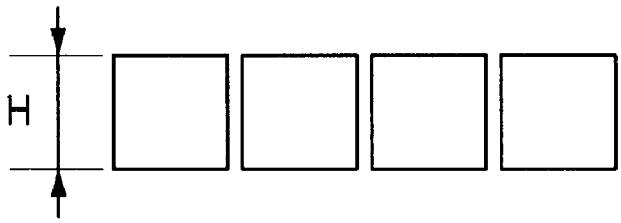
FIG. 6 is a schematic front view illustrating the rectangular light emission surface having a short side larger than 0.8 mm (for example, H=1 mm)

With reference to FIG. 6, a description will be given of a conventional vehicle light that is assumed to have a rectangular light emission surface having a short side larger than 0.8 mm (for example, H=1 mm). In this case, due to the relationship between the BF value of the projection lens 30, the F value of the reflecting surface 20, and the like, the light emission surface of the LED light source can be projected on the virtual vertical screen as a light source image $I_{h1}$ extending in the horizontal direction and having a height h1 (see FIG. 7).

FIG. 5 shows the case where the light source image $I_{h1}$ extending in the horizontal direction and having a height h1 is projected onto the actual road surface projection area. As shown, in this case the light source image $I_{h1}$ is projected across both the farther area A and the intermediate area B of the road surface. This means that the road surface illuminance cannot be controlled separately at the respective areas A to C. In addition, if the light source is controlled to obtain a maximum light intensity at the farther area A with a certain brightness, the nearer intermediate area B may become too bright (see the graph G2 in FIG. 8B). As a result, the sense of brightness in the farther area A may deteriorate.

Figure 9A:
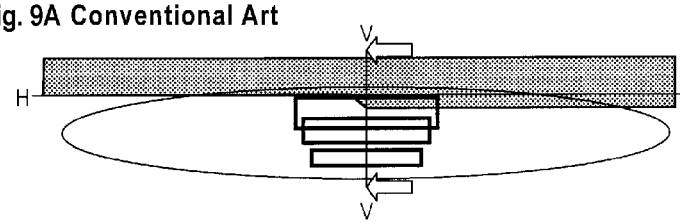
Fig. 9A Conventional Art
FIG. 9A is a diagram illustrating the horizontal light source image $I_{h1}$ projected on the virtual vertical screen S in the case wherein a conventional vehicle light utilizes a rectangular light emission surface with a short side H=1 mm.
Figure 9B:
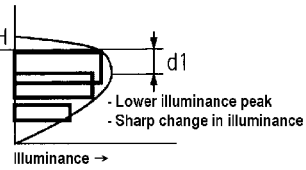
Fig. 9B Conventional Art
FIG. 9B is an illuminance distribution curve in a vertical cross section including line V-V in FIG. 9A.
Figure 9C:
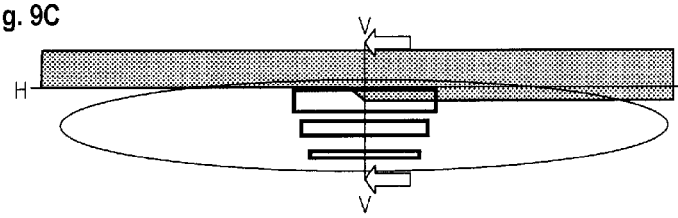
FIG. 9C is a diagram illustrating the horizontal light source image $I_{h2}$ projected on the virtual vertical screen S in the case wherein an embodiment of a vehicle light made in accordance with principles of the presently disclosed subject matter utilizes a rectangular light emission surface having a short side H=0.7 mm.
Figure 10A:
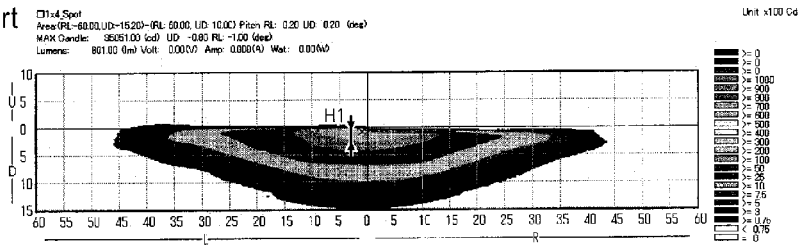
Fig. 10A Conventional Art
FIG. 10A is a diagram illustrating a light distribution pattern projected on a virtual vertical screen S when a conventional vehicle light utilizes a rectangular light emission surface with a shorter side of 1.0 mm.
Figure 11:
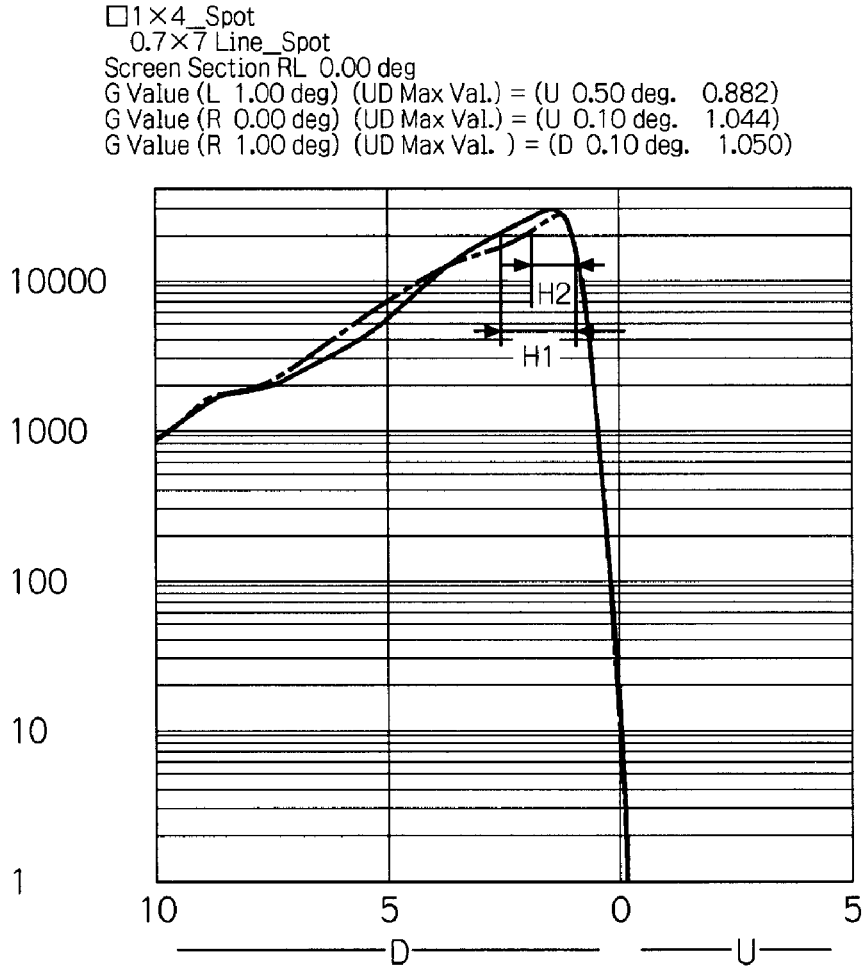
FIG. 11 is a graph showing the detailed data corresponding to FIGS. 9B and 9D.

When the conventional vehicle light utilizing a rectangular light emission surface having a short side larger than 0.8 mm (for example, H=1 mm) is used as shown in FIG. 4, the illumination peak in the light distribution pattern P1 (see FIG. 4) may be disadvantageously positioned below the target position, for example, at d1 below the horizontal line H-H (see FIG. 9B), where the target position is the position below the horizontal line H-H by 0.5°. In addition, the high intensity area may be formed as a broader area across the horizontal line H-H and the below area H1 (see FIG. 10A and FIG. 11).

On the other hand, when the exemplary vehicle light 100 of the presently disclosed subject matter utilizing the rectangular light emission surface 10A having a short side within a range of 0.6 to 0.8 mm (for example, H=0.7 mm) is used, since the reflecting surface 20 can have reflecting areas that are each configured for projecting the light source image onto a corresponding one of the areas A to C, the light source image $I_{h1}$ of the light source 10 (light emission surface 10A) extending in the horizontal direction is projected onto the corresponding one of the areas A to C without striding across the adjacent areas.

Accordingly, by the action of the reflecting surface 20, the light emission surface 10A can be projected on the virtual vertical screen S as a light source image $I_{h2}$ extending in the horizontal direction and having a height h2 (see FIG. 12).

Figure 13:
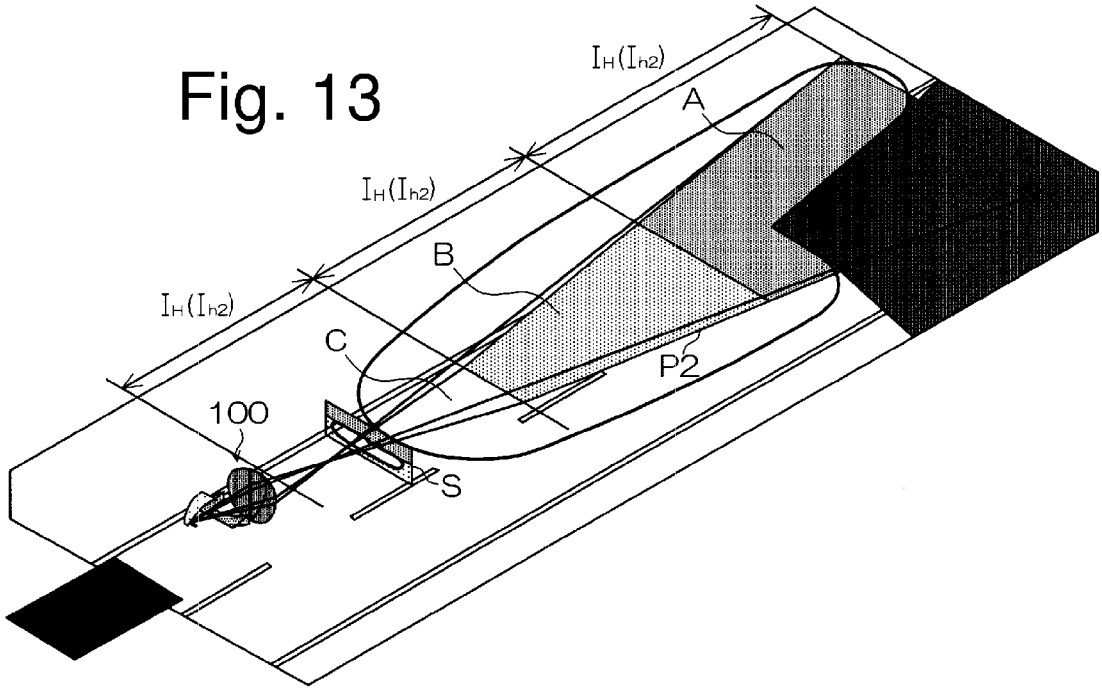
FIG. 13 is a perspective view illustrating an embodiment of a vehicle light made in accordance with principles of the presently disclosed subject matter utilizing the rectangular light emission surface with a shorter side H of 0.7 mm, specifically how the horizontal light source image $I_{h2}$ with the height h2 is projected on a road surface separately in the respective areas A to C.

FIG. 13 shows the case where the light source image $I_{h2}$ extending in the horizontal direction and having a height h2 is projected onto the actual road surface projection area (for a left hand drive vehicle as shown in this embodiment). In this case the light source image $I_{h2}$ is projected onto the farther area A, the intermediate area B, and the nearby area C separately. Specifically, the reflecting surface 20 can be adjusted so that the light source images $I_{h2}$ extending in the horizontal direction can be adjusted in terms of the number, size, and the like so as to be projected onto the respective farther area A, intermediate area B and nearby area C. Accordingly, the road surface illuminances in the respective areas A to C can be separately adjusted. For example, the light source images can be adjusted so that the brightness in the farther area can be increased to provide an appropriate maximum light intensity. In this case, since the projected light onto the farther area A is not projected onto the nearer intermediate area B, the light intensity in the area B can be appropriately controlled to be darkened (or lightened). Accordingly, the maximum light intensity can be maintained while the sense of brightness in the farther area can be improved. In this way, the road surface illuminances in the respective areas A to C can be separately controlled, thereby optimizing the road surface illuminances in the respective areas A to C. Specifically, the farther area A can be illuminated brighter while the nearer intermediate area B adjacent to the area A can be illuminated to an appropriate lesser degree, so that the vehicle light can provide an illuminance distribution similar to that of an HID lamp (for example, a graph G3 in FIG. 8B) even when the vehicle light utilizes the LED light source 10.

Figure 7:
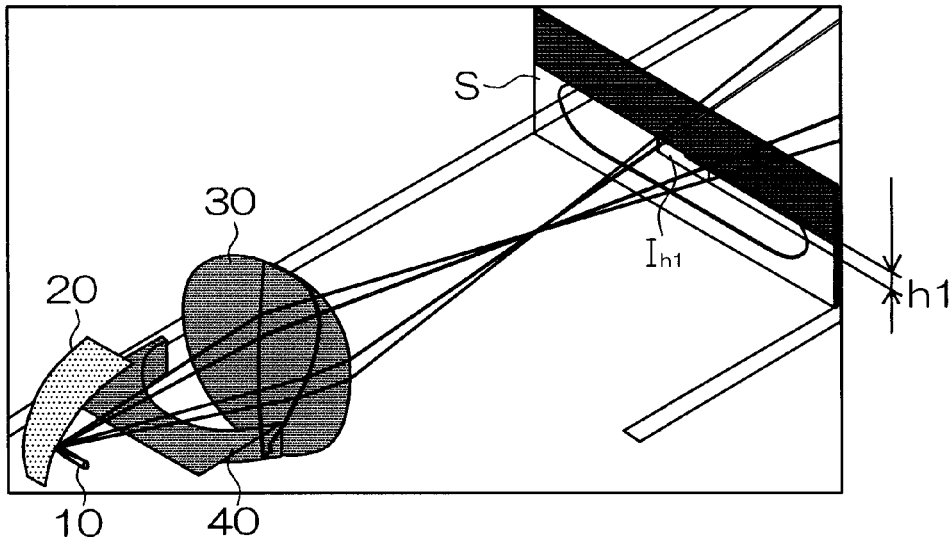
FIG. 7 is a schematic perspective view illustrating the height h1 of the light source image $I_{h1}$ projected on the virtual vertical screen S in the case wherein a rectangular light emission surface has a short side larger than 0.8 mm (for example, H=1 mm)
Figure 9D:
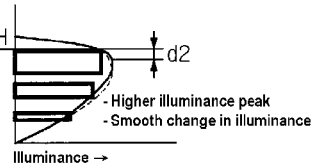
FIG. 9D is an illuminance distribution curve in a vertical cross section including line V-V in FIG. 9C.
Figure 10B:
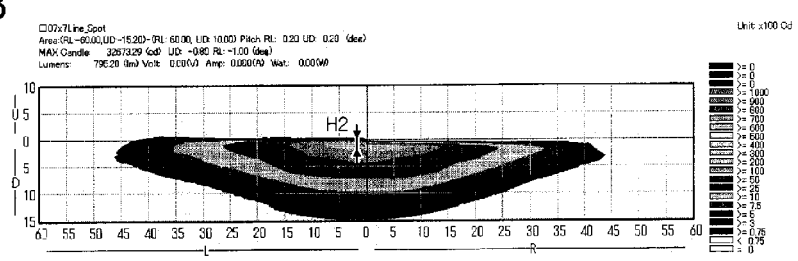
FIG. 10B is a diagram illustrating a light distribution pattern projected on a virtual vertical screen S when an embodiment of a vehicle light made in accordance with principles of the presently disclosed subject matter utilizes a rectangular light emission surface with a shorter side of 0.7 mm.

When a vehicle light of the presently disclosed subject matter utilizes a rectangular light emission surface 10A with a shorter side of 0.6 to 0.8 mm, for example, H=0.7 mm, the height h2 of the light source image $I_{h2}$ extending in the horizontal direction may be smaller than the height h1 of the light source image $I_{h1}$ of the conventional vehicle light as shown in FIG. 7 and FIG. 12 (h2<h1). Accordingly, the plurality of light source image $I_{h2}$ extending in the horizontal direction can be densely disposed near the cut-off line. Namely, when compared with the case of the broad peak d1 of the conventional vehicle light shown in FIG. 9B, the illumination peak in the light distribution pattern formed by the exemplary vehicle light of the presently disclosed subject matter can be advantageously positioned near the target position, for example, at d2 below the horizontal line H-H (see FIG. 9D), where the target position is the position below the horizontal line H-H by 0.5°. Further, the peak can be sharper than the peak of the conventional vehicle light. In addition, the high intensity area H2 can be formed as a sharper area nearer the horizontal line H-H (see FIG. 10B) as compared to the conventional vehicle light with the high intensity area H1 (see FIG. 10A). This can increase the light intensity near the cut-off line, thereby improving the distance visibility.

In view of this, the present exemplary embodiment can achieve the above characteristics by providing the rectangular light emission surface 10A with the short side of 0.6 to 0.8 mm, for example, of 0.7 mm.

It should be noted that, when the short side H of the light emission surface 10A is too short, the overlaid degree of the plurality of light source images $I_{h2}$ extending in the horizontal direction may be decreased to cause light distribution unevenness, meaning the desired light intensity cannot be obtained with ease. After examining while taking this into consideration, the inventor has found that the lower limit of the short side H of the light emission surface 10A is approx. 0.6 mm.

Figure 14:
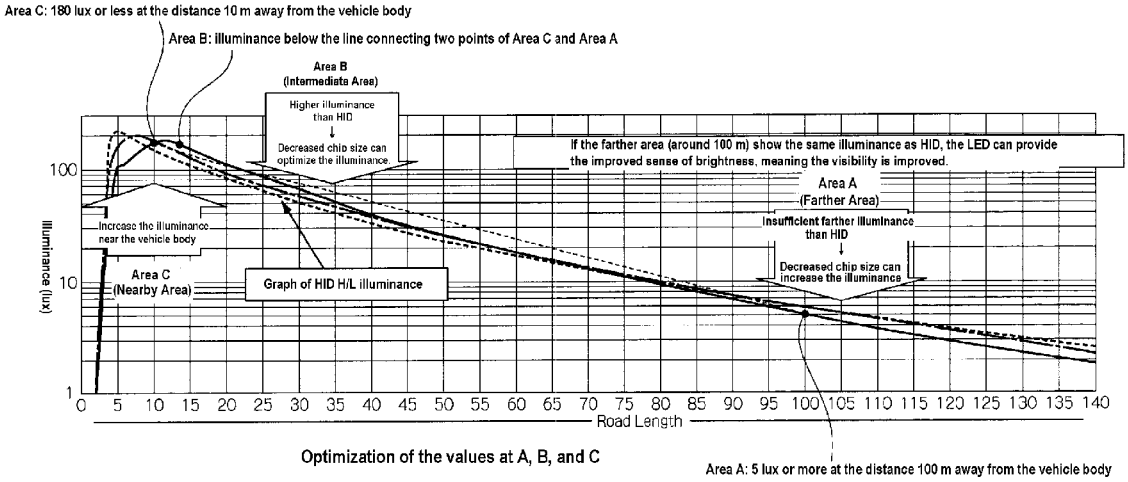
FIG. 14 is a diagram illustrating how the road surface illuminance is optimized in each of the areas including the farther area, the intermediate area, and the nearby area disposed in front of the vehicle light of FIG. 13.

With reference to FIG. 14, a description will be given of the illuminance on the road surface projection area. FIG. 14 is a diagram illustrating the farther area, the intermediate area, and the nearby area extending in front of the vehicle light and the optimized road surface illuminance at each area by a solid line. In order to improve the distance visibility, an exemplary vehicle light made in accordance with principles of the presently disclosed subject matter can provide a road surface illuminance of 5 lux or more at the farther area A and of 180 lux or less at the nearby area C. The road surface illuminance in the intermediate area B may take a value positioned below a straight line in a coordinate system with the road surface illuminance being a vertical axis and the distance from the vehicle body being a horizontal axis, the line connecting the road surface illuminance in the farther area at a distance around 100 m away from the vehicle body in front of the vehicle body and the road surface illuminance in the nearby area at a distance around 10 m away from the vehicle body in front of the vehicle body in that coordinate system.

As described above, the vehicle light 100 of the presently disclosed subject matter can have the LED light source 10, the reflecting surface 20, and the like with the above configuration. By the action of the LED light source 10, the reflecting surface 20, and the like, the plurality of horizontally extending light source images $I_{h2}$ with the determined number and size can be adjusted with respect to the farther area A, the intermediate area B, and the nearby area C of the road surface projection area in front of the vehicle body. This configuration can separately control the road surface illuminances at the respective areas A to C. For example, the combinations of the light source images can be separately disposed at the farther area A and the intermediate area B appropriately, whereby the farther area A can be illuminated brighter while the nearer intermediate area B adjacent to the area A can be illuminated appropriately and respectively darker. Accordingly, the maximum light intensity in the light distribution pattern can be maintained while the sense of brightness in the farther area can be improved. In this way, the road surface illuminances in the respective areas A to C can be separately controlled by the defined LED light source 10, reflecting surface 20, and the like of the exemplary vehicle light 100, thereby optimizing the road surface illuminances in the respective areas A to C. In the above exemplary embodiment, a projector type optical system including a rectangular light emission surface 10A (with the shorter side of 0.6 to 0.8 mm, in particular, 0.7 mm), the reflecting surface 20, the projection lens 30, and the shade 40 has been described with reference to FIG. 2 to optimize the road surface illuminances in the respective areas A to C. However, the presently disclosed subject matter is not limited to this embodiment.

Figure 15:
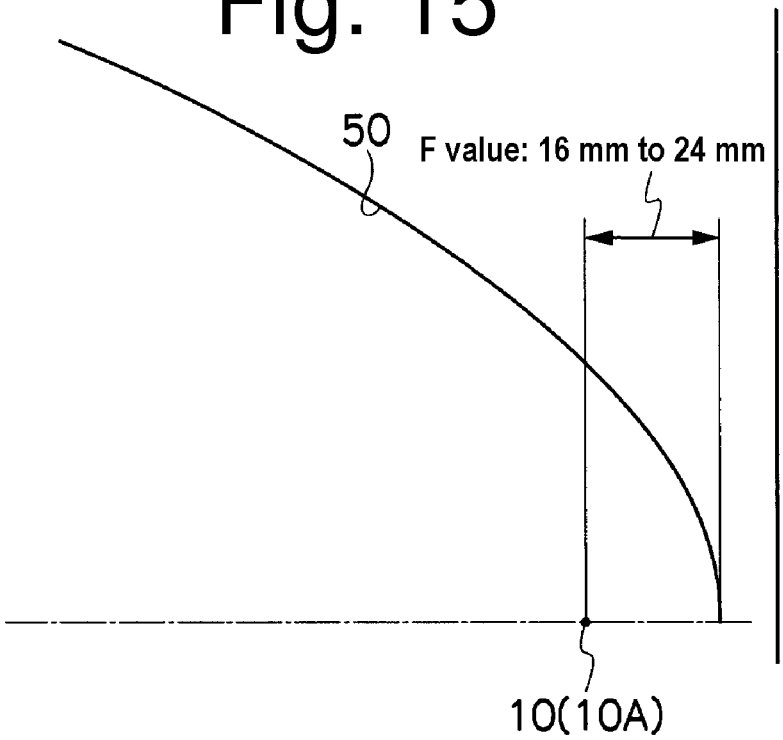
FIG. 15 is a schematic vertical cross sectional view showing part of an embodiment of a vehicle light made in accordance with principles of the disclosed subject matter as a modified example of one exemplary embodiment of the presently disclosed subject matter.

For example, as a modified example, an LED light source 10 with a rectangular light emission surface 10A with a shorter side of 0.6 to 0.8 mm, for example, of 0.7 mm can be combined with a reflector type optical system having a revolved parabolic reflecting surface 50 (with F value of 16 to 24 mm) so that the road surface illuminances in the respective areas A to C can be optimized. FIG. 15 is a schematic vertical cross sectional view showing the positional relationship between these components.

In this modified example, the reflecting surface 50 can have reflecting areas each configured for projecting the horizontally extending light source images $I_{h2}$ of the LED light source 10 (light emission surface 10A) onto a corresponding one of the areas A to C, at least without striding across the adjacent areas. The reflecting surface 50 can be adjusted, so that the light source images $I_{h2}$ extending in the horizontal direction can be adjusted in terms of the number, size, and the like so as to be projected onto the respective farther area A, intermediate area B and nearby area C. With this configuration, the road surface illuminances in the respective areas A to C can be separately adjusted. For example, the combinations of the light source images can be separately disposed at the farther area A and the intermediate area B appropriately also in this modified example, whereby the farther area A can be illuminated brighter while the nearer intermediate area B adjacent to the area A can be illuminated appropriately darker. Accordingly, the maximum light intensity in the light distribution pattern can be maintained while the sense of brightness in the farther area can be improved. In this way, the road surface illuminances in the respective areas A to C can be separately controlled by the defined LED light source 10, reflecting surface 50, and the like, thereby optimizing the road surface illuminances in the respective areas A to C. Also, the farther area A can be illuminated brighter while the nearer intermediate area B adjacent to the area A can be illuminated appropriately darker, so that the vehicle light can provide an illuminance distribution similar to that of an HID lamp (for example, a graph G3 in FIG. 8B) even when the vehicle light utilizes the LED light source 10.

Figure 16:
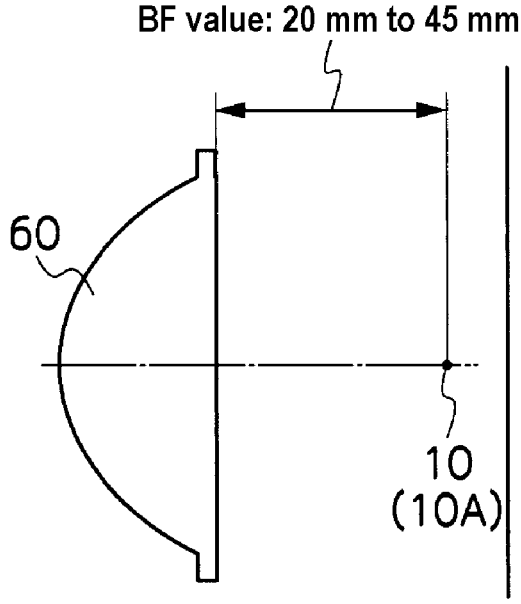
FIG. 16 is a schematic vertical cross sectional view showing part of an embodiment of a vehicle light made in accordance with principles of the disclosed subject matter as a modified example 2 of one exemplary embodiment of the presently disclosed subject matter.

A description will next be give of a modified example 2. In the modified example 2, an LED light source 10 with a rectangular light emission surface 10A with a shorter side of 0.6 to 0.8 mm, for example, of 0.7 mm can be combined with a direct type optical system having a projection lens 60 (with BF value of 20 to 45 mm) disposed in front of the LED light source 10 so that the road surface illuminances in the respective areas A to C can be optimized. FIG. 16 is a schematic vertical cross sectional view showing the positional relationship between these components.

Also in this modified example 2, the projection lens 60 can be configured to project the horizontally extending light source images $I_{h2}$ of the LED light source 10 (light emission surface 10A) onto a corresponding one of the areas A to C, at least without striding across the adjacent areas. The projector lens 60 can be adjusted, so that the light source images $I_{h2}$ extending in the horizontal direction can be adjusted in terms of the number, size, and the like so as to be projected onto the respective farther area A, intermediate area B and nearby area C. With this configuration, the road surface illuminances in the respective areas A to C can be separately adjusted. For example, in this modified example 2, the combinations of the light source images can again be separately disposed at the farther area A and the intermediate area B appropriately, whereby the farther area A can be illuminated brighter while the nearer intermediate area B adjacent to the area A can be illuminated appropriately darker. Accordingly, the maximum light intensity in the light distribution pattern can be maintained while the sense of brightness in the farther area can be improved. In this way, the road surface illuminances in the respective areas A to C can be separately controlled by the defined LED light source 10, projection lens 60, and the like, thereby optimizing the road surface illuminances in the respective areas A to C. Also, the farther area A can be illuminated brighter while the nearer intermediate area B adjacent to the area A can be illuminated appropriately darker, so that the vehicle light can provide an illuminance distribution similar to that of an HID lamp (for example, a graph G3 in FIG. 8B) even when the vehicle light utilizes the LED light source 10.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light configured to be provided in a front portion of a vehicle body, the vehicle light comprising:

a plurality of light sources configured to form a road surface light distribution pattern on a road surface in front of the vehicle body, the road surface including at least a farther area, an intermediate area, and a nearby area, the road surface light distribution pattern including a plurality of light source images each extending in a horizontal direction, the plurality of light sources being configured such that during operation of the plurality of light sources the respective light source images are projected to a corresponding one of the farther area, the intermediate area, and the nearby area, respectively, without striding across adjacent areas; and an optical system comprising at least one of a reflective surface and a projection lens that is configured to project the plurality of light source images each extending in a horizontal direction to the corresponding one of the farther area, the intermediate area, and the nearby area.

2. The vehicle light according to claim 1, wherein the farther area is an area in front of the vehicle body 100 m or more away from the vehicle body, the nearby area is an area in front of the vehicle body 10 m or less away from the vehicle body, and the intermediate area is an area interposed between the farther area and the nearby area.

3. The vehicle light according to claim 1, wherein the light sources are configured to provide a road surface illuminance in the farther area of 5 lux or more, a road surface illuminance in the nearby area of 180 lux or less, and a road surface illuminance in the intermediate area being an illuminance value positioned below a straight line in a coordinate system with the road surface illuminance being a vertical axis and the distance from the vehicle body being a horizontal axis, the line connecting the road surface illuminance in the farther area at a distance substantially 100 m away from the vehicle body in front of the vehicle body and the road surface illuminance in the nearby area at a distance substantially 10 m away from the vehicle body in front of the vehicle body in the coordinate system.

4. The vehicle light according to claim 2, wherein the light sources are configured to provide a road surface illuminance in the farther area of 5 lux or more, a road surface illuminance in the nearby area of 180 lux or less, and a road surface illuminance in the intermediate area being an illuminance value positioned below a straight line in a coordinate system with the road surface illuminance being a vertical axis and the distance from the vehicle body being a horizontal axis, the line connecting the road surface illuminance in the farther area at a distance substantially 100 m away from the vehicle body in front of the vehicle body and the road surface illuminance in the nearby area at a distance substantially 10 m away from the vehicle body in front of the vehicle body in the coordinate system.

5. The vehicle light according to claim 1, wherein an illuminance peak in the light distribution pattern formed on a virtual vertical screen positioned a predetermined distance away from the vehicle body in front of the vehicle body is disposed below a horizontal line in the light distribution pattern by substantially 0.5°.

6. The vehicle light according to claim 2, wherein an illuminance peak in the light distribution pattern formed on a virtual vertical screen positioned a predetermined distance away from the vehicle body in front of the vehicle body is disposed below a horizontal line in the light distribution pattern by substantially 0.5°.

7. The vehicle light according to claim 3, wherein an illuminance peak in the light distribution pattern formed on a virtual vertical screen positioned a predetermined distance away from the vehicle body in front of the vehicle body is disposed below a horizontal line in the light distribution pattern by substantially 0.5°.

8. The vehicle light according to claim 4, wherein an illuminance peak in the light distribution pattern formed on a virtual vertical screen positioned a predetermined distance away from the vehicle body in front of the vehicle body is disposed below a horizontal line in the light distribution pattern by substantially 0.5°.

9. The vehicle light according to claim 1, wherein the plurality of light sources includes an LED light source having a rectangular light emission surface with a short side of 0.6 to 0.8 mm.

10. The vehicle light according to claim 2, wherein the plurality of light sources includes an LED light source having a rectangular light emission surface with a short side of 0.6 to 0.8 mm.

11. The vehicle light according to claim 3, wherein the plurality of light sources includes an LED light source having a rectangular light emission surface with a short side of 0.6 to 0.8 mm.

12. The vehicle light according to claim 4, wherein the plurality of light sources includes an LED light source having a rectangular light emission surface with a short side of 0.6 to 0.8 mm.

13. The vehicle light according to claim 5, wherein the plurality of light sources includes an LED light source having a rectangular light emission surface with a short side of 0.6 to 0.8 mm.

14. The vehicle light according to claim 6, wherein the plurality of light sources includes an LED light source having a rectangular light emission surface with a short side of 0.6 to 0.8 mm.

15. The vehicle light according to claim 7, wherein the plurality of light sources includes an LED light source having a rectangular light emission surface with a short side of 0.6 to 0.8 mm.

16. The vehicle light according to claim 8, wherein the plurality of light sources includes an LED light source having a rectangular light emission surface with a short side of 0.6 to 0.8 mm.

17. The vehicle light according to claim 9, wherein the optical system is a projector type optical system including a projection lens, a reflecting surface, and a light shielding member having an upper edge and disposed between the projection lens and the reflecting surface, the reflecting surface is a revolved elliptical reflecting surface having a first focal point substantially at the light emission surface of the LED light source and a second focal point disposed substantially at the upper edge of the light shielding member, and the projection lens has a focal point substantially at the upper edge of the light shielding member.

18. The vehicle light according to claim 17, wherein the projection lens has a focal distance of 20 to 45 mm, the reflecting surface has a focal distance of 7 to 15 mm, and a distance between the focal point of the projection lens and the first focal point of the reflecting surface is set to a range of 30 to 45 mm, the reflecting surface is configured to project the plurality of light source images each extending in the horizontal direction to the corresponding one of the farther area, the intermediate area, and the nearby area, respectively, without striding across the adjacent areas.

19. The vehicle light according to claim 17, wherein the optical system is a reflector type optical system including a revolved parabolic reflecting surface having a focal point disposed substantially at the light emission surface of the LED light source.

20. The vehicle light according to claim 19, wherein the reflecting surface has a focal distance of 16 to 24 mm, and the reflecting surface is configured to project the plurality of light source images each extending in the horizontal direction to the corresponding one of the farther area, intermediate area, and nearby area, respectively, without striding across the adjacent areas.

21. The vehicle light according to claim 17, wherein the optical system is a direct type optical system including a projection lens having a focal point disposed substantially at the light emission surface of the LED light source.

22. The vehicle light according to claim 21, wherein the projection lens has a rear-side focal distance of 20 to 45 mm, and the projection lens is configured to project the plurality of light source images each extending in the horizontal direction to the corresponding one of the farther area, the intermediate area, and the nearby area, respectively, without striding across the adjacent areas.

* * * * *